US008297375B2

(12) United States Patent
Hall et al.

(10) Patent No.: US 8,297,375 B2
(45) Date of Patent: Oct. 30, 2012

(54) DOWNHOLE TURBINE

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 833 days.

(21) Appl. No.: 12/262,398

(22) Filed: Oct. 31, 2008

(65) Prior Publication Data

US 2009/0057016 A1 Mar. 5, 2009

Related U.S. Application Data

(63) Continuation of application No. 12/262,372, filed on Oct. 31, 2008, now Pat. No. 7,730,972, which is a continuation-in-part of application No. 12/178,467, filed on Jul. 23, 2008, now Pat. No. 7,730,975, which is a continuation-in-part of application No. 12/039,608, filed on Feb. 28, 2008, now Pat. No. 7,762,353, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, (Continued)

(51) Int. Cl.
*E21B 4/02* (2006.01)

(52) U.S. Cl. ..... 175/57; 175/107; 175/324

(58) Field of Classification Search ..... 175/107, 175/57, 324

See application file for complete search history.

(56) References Cited

U.S. PATENT DOCUMENTS 616,118 A 12/1889 Kunhe (Continued)

OTHER PUBLICATIONS

Patent Cooperation Treaty, International Search Report and Written Opinion of the International Searching Authority for PCT/US07/64544, date of mailing Aug. 5, 2008.

(Continued)

*Primary Examiner* — Hoang Dang

(74) *Attorney, Agent, or Firm* — Brinks Hofer Gilson & Lione

(57) ABSTRACT

In one aspect of the present invention, a drill bit has a jack element that is substantially coaxial with an axis of rotation of the drill bit and the jack element has an asymmetrical distal end that extends beyond a working face of the drill bit. A turbine is located within a bore formed in the drill bit and a flow valve is actuated by the turbine. The flow valve is adapted to route a drilling fluid in the bore into a porting mechanism adapted to extend the jack element farther beyond the working surface of the drill bit. The turbine is also adapted to rotate the jack element at variable speeds.

17 Claims, 12 Drawing Sheets

Related U.S. Application Data filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/262,398, which is a continuation-in-part of application No. 11/278,935, filed on Apr. 6, 2006, now Pat. No. 7,426,968, which is a continuation-in-part of application No. 11/277,394, filed on Mar. 24, 1996, now Pat. No. 7,398,837, and a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, application No. 12/262,398, which is a continuation-in-part of application No. 11/555,334, filed on Nov. 1, 2006, now Pat. No. 7,419,018.

(56) References Cited

U.S. PATENT DOCUMENTS

| | | | |
|---|---|---|---|
| 465,103 | A | 12/1891 | Wegner |
| 923,513 | A | 6/1909 | Hardsocg |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,258,418 | A | 3/1918 | Kemble |
| 1,360,908 | A | 11/1920 | Everson |
| 1,372,257 | A | 3/1921 | Swisher |
| 1,387,733 | A | 8/1921 | Midgett |
| 1,460,671 | A | 7/1923 | Habsacker |
| 1,544,757 | A | 7/1925 | Hufford |
| 1,712,948 | A | 5/1929 | Burch |
| 1,746,455 | A | 2/1930 | Woodruff et al. |
| 1,746,456 | A | 2/1930 | Allington |
| 2,169,223 | A | 8/1931 | Christian |
| 1,821,474 | A | 9/1931 | Mercer |
| 1,836,638 | A | 12/1931 | Wright et al. |
| 1,879,177 | A | 9/1932 | Gault |
| 1,921,135 | A | 8/1933 | Santiago |
| 2,054,255 | A | 9/1936 | Howard |
| 2,064,255 | A | 12/1936 | Garfield |
| 2,153,034 | A | 4/1939 | Baker |
| 2,170,452 | A | 8/1939 | Grant |
| 2,196,657 | A | 4/1940 | Burt |
| 2,196,940 | A | 4/1940 | Potts |
| 2,218,130 | A | 10/1940 | Court |
| 2,227,233 | A | 12/1940 | Scott et al. |
| 2,300,016 | A | 10/1942 | Scott et al. |
| 2,320,136 | A | 5/1943 | Kammerer |
| 2,320,670 | A | 6/1943 | Scaramucci |
| 2,345,024 | A | 3/1944 | Bannister |
| 2,371,248 | A | 3/1945 | McNamara |
| 2,414,719 | A | 1/1947 | Cloud |
| 2,427,052 | A | 9/1947 | Grant |
| 2,466,991 | A | 4/1949 | Kammerer |
| 2,498,192 | A | 2/1950 | Wright |
| 2,540,464 | A | 2/1951 | Stokes |
| 2,544,036 | A | 3/1951 | Kammerer |
| 2,545,036 | A | 3/1951 | Kammerer |
| 2,575,173 | A | 11/1951 | Johnson |
| 2,619,325 | A | 1/1952 | Arutunoff |
| 2,615,519 | A | 10/1952 | Carr |
| 2,626,780 | A | 1/1953 | Ortloff |
| 2,643,860 | A | 6/1953 | Koch |
| 2,725,215 | A | 11/1955 | Macneir |
| 2,735,653 | A | 2/1956 | Bielstein |
| 2,737,244 | A | 3/1956 | Baker et al. |
| 2,755,071 | A | 7/1956 | Kammerer |
| 2,776,819 | A | 1/1957 | Brown |
| 2,819,041 | A | 1/1958 | Beckham |
| 2,819,043 | A | 1/1958 | Henderson |
| 2,838,284 | A | 6/1958 | Austin |
| 2,873,093 | A | 2/1959 | Hildebrandt et al. |
| 2,877,984 | A | 3/1959 | Causey |
| 2,894,722 | A | 7/1959 | Buttolph |
| 2,901,223 | A | 8/1959 | Scott |
| 2,937,008 | A | 5/1960 | Whittle |
| 2,940,039 | A | 6/1960 | Yost et al. |
| 2,942,850 | A | 6/1960 | Heath |
| 2,953,102 | A | 12/1960 | Smith |
| 2,963,102 | A | 12/1960 | Smith |
| 2,998,085 | A | 8/1961 | Dulaney |
| 3,001,584 | A | 9/1961 | Scott |
| 3,036,645 | A | 5/1962 | Rowley |
| 3,039,531 | A | 6/1962 | Scott |
| 3,054,415 | A | 9/1962 | Baker et al. |
| 3,055,443 | A | 9/1962 | Edwards |
| 3,058,532 | A | 10/1962 | Alder |
| 3,075,592 | A | 1/1963 | Overly et al. |
| 3,077,936 | A | 2/1963 | Arutunoff |
| 3,126,065 | A | 3/1964 | Chadderdon |
| 3,130,783 | A | 4/1964 | Orr |
| 3,135,341 | A | 6/1964 | Ritter |
| 3,139,147 | A | 6/1964 | Hays et al. |
| 3,163,243 | A | 12/1964 | Cleary |
| 3,187,191 | A | 6/1965 | Baggs |
| 3,216,514 | A | 11/1965 | Nelson |
| 3,251,424 | A | 5/1966 | Brooks |
| 3,294,186 | A | 12/1966 | Buell |
| 3,301,339 | A | 1/1967 | Pennebaker |
| 3,303,899 | A | 2/1967 | Jones et al. |
| 3,336,988 | A | 8/1967 | Jones |
| 3,342,267 | A | 9/1967 | Cotter et al. |
| 3,362,488 | A | 1/1968 | Ioanesyan et al. |
| 3,379,264 | A | 4/1968 | Cox |
| 3,403,729 | A | 10/1968 | Hickey |
| 3,429,390 | A | 2/1969 | Bennett |
| 3,433,331 | A | 3/1969 | Heyberger |
| 3,455,158 | A | 7/1969 | Richter et al. |
| 3,493,165 | A | 2/1970 | Schonfield |
| 3,583,504 | A | 6/1971 | Aalund |
| 3,635,296 | A | 1/1972 | Lebourg |
| 3,700,049 | A | 10/1972 | Tiraspolsky et al. |
| 3,703,104 | A | 11/1972 | Tamplen |
| 3,732,143 | A | 5/1973 | Joosse |
| 3,758,731 | A | 9/1973 | Vann et al. |
| 3,764,493 | A | 10/1973 | Rosar |
| 3,765,493 | A | 10/1973 | Rosar et al. |
| 3,807,512 | A | 4/1974 | Pogonowski et al. |
| 3,815,692 | A | 6/1974 | Varley |
| 3,821,993 | A | 7/1974 | Kniff |
| 3,823,773 | A | 7/1974 | Nutter |
| 3,867,655 | A | 2/1975 | Stengel et al. |
| 3,899,033 | A | 8/1975 | Huisen |
| 3,936,683 | A | 2/1976 | Walker |
| 3,955,635 | A | 5/1976 | Skidmore |
| 3,960,223 | A | 6/1976 | Kleine |
| 3,967,201 | A | 6/1976 | Rorden |
| 3,971,450 | A | 7/1976 | Fox |
| 3,978,931 | A | 9/1976 | Sudnishnikov et al. |
| 3,986,554 | A | 10/1976 | Nutter |
| 3,989,114 | A | 11/1976 | Tschirky et al. |
| 4,007,797 | A | 2/1977 | Jeter |
| 4,015,234 | A | 3/1977 | Krebs |

4,033,408 A 7/1977 Fredd et al.
4,081,042 A 3/1978 Johnson
4,096,917 A 6/1978 Harris
4,106,577 A 8/1978 Summers
4,132,243 A 1/1979 Kuus
RE30,055 E 7/1979 Claycomb
4,165,790 A 8/1979 Emmerich
4,173,457 A 11/1979 Smith
4,176,723 A 12/1979 Arceneaux
4,207,485 A 6/1980 Silver
4,211,291 A 7/1980 Kellner
4,253,533 A 3/1981 Baker
4,262,758 A 4/1981 Evans
4,266,605 A 5/1981 LaBorde et al.
4,277,707 A 7/1981 Silver et al.
4,280,573 A 7/1981 Sudnishnikov
4,283,779 A 8/1981 Lamel
4,304,312 A 12/1981 Larsson
4,307,786 A 12/1981 Evans
4,386,669 A 6/1983 Evans
4,397,361 A 8/1983 Langford
4,416,339 A 11/1983 Baker
4,416,494 A 11/1983 Watkins et al.
4,445,580 A 5/1984 Sahley
4,448,269 A 5/1984 Ishikawa et al.
4,462,469 A 7/1984 Brown
4,478,296 A 10/1984 Richman
4,491,187 A 1/1985 Russell
4,491,738 A 1/1985 Kamp
4,499,795 A 2/1985 Radtke
4,520,870 A 6/1985 Pringle
4,531,592 A 7/1985 Hayatdavoudi
4,532,614 A 7/1985 Peppers
4,535,853 A 8/1985 Ippolito
4,538,691 A 9/1985 Dennis
4,564,068 A 1/1986 Baugh
4,566,545 A 1/1986 Story
4,574,894 A 3/1986 Jadwin
4,574,895 A 3/1986 Dolezal
4,578,675 A 3/1986 MacLeod
4,583,592 A 4/1986 Gazda et al.
4,592,432 A 6/1986 Williams et al.
4,596,293 A 6/1986 Wallussek et al.
4,597,454 A 7/1986 Schoeffler
4,612,987 A 9/1986 Cheek
4,624,306 A 11/1986 Traver et al.
4,632,193 A 12/1986 Geczy
4,637,479 A 1/1987 Leising
4,640,374 A 2/1987 Dennis
4,655,289 A 4/1987 Schoeffler
4,676,310 A 6/1987 Scherbatskoy et al.
4,679,637 A 7/1987 Cherrington
4,683,781 A 8/1987 Kar et al.
4,720,640 A 1/1988 Anderson et al.
4,721,172 A 1/1988 Brett et al.
4,722,661 A 2/1988 Mizuno
4,732,223 A 3/1988 Schoeffler
4,732,225 A 3/1988 Jurgens et al.
4,754,181 A 6/1988 Mizobuchi et al.
4,775,017 A 10/1988 Forrest et al.
4,782,894 A 11/1988 LaFleur
4,785,247 A 11/1988 Meador et al.
4,788,544 A 11/1988 Howard
4,802,150 A 1/1989 Russell et al.
4,806,928 A 2/1989 Veneruso
4,819,745 A 4/1989 Walter
4,830,122 A 5/1989 Walter
4,836,301 A 6/1989 Van Dongen et al.
4,852,672 A 8/1989 Behrens
4,869,100 A 9/1989 Birdwell
4,889,017 A 12/1989 Fuller
4,889,199 A 12/1989 Lee
4,893,678 A 1/1990 Stokley et al.
4,895,214 A 1/1990 Schoeffler
4,907,665 A 3/1990 Kar et al.
4,924,949 A 5/1990 Curlett
4,928,520 A 5/1990 Barrington
4,962,822 A 10/1990 Pascale
4,965,998 A 10/1990 Estigoy et al.
4,974,688 A 12/1990 Helton
4,981,184 A 1/1991 Knowlton
4,991,667 A 2/1991 Wilkes et al.
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,090,944 A 2/1992 Kyo et al.
5,094,304 A 3/1992 Briggs
5,098,258 A 3/1992 Barnetche-Gonzalez
5,103,919 A 4/1992 Warren et al.
5,112,188 A * 5/1992 Barnetche-Gonzalez . 415/198.1
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,189,645 A 2/1993 Innes
5,222,566 A 6/1993 Taylor
5,230,390 A 7/1993 Zastresek et al.
5,232,058 A 8/1993 Morin et al.
5,248,896 A 9/1993 Forrest
5,255,749 A 10/1993 Bumpurs
5,259,469 A 11/1993 Stjernstrom et al.
5,265,682 A 11/1993 Russell
5,270,600 A 12/1993 Hashimoto
5,311,953 A 5/1994 Walker
5,314,030 A 5/1994 Peterson et al.
5,316,094 A 5/1994 Pringle
5,337,002 A 8/1994 Mercer
5,361,859 A 11/1994 Tibbitts
5,388,649 A 2/1995 Ilomaki
5,392,862 A 2/1995 Swearingen
5,410,303 A 4/1995 Comeau
5,415,030 A 5/1995 Jogi et al.
5,417,292 A 5/1995 Polakoff
5,423,389 A 6/1995 Warren
5,475,309 A 12/1995 Hong et al.
5,499,687 A 3/1996 Lee
5,507,357 A 4/1996 Hult
5,517,464 A 5/1996 Lerner et al.
5,539,258 A 7/1996 Sutton et al.
5,553,678 A 9/1996 Barr et al.
5,560,440 A 10/1996 Tibbitts
5,568,838 A 10/1996 Struthers
5,584,342 A 12/1996 Swinford
5,609,178 A 3/1997 Hennig et al.
5,626,200 A 5/1997 Gilbert et al.
5,642,782 A 7/1997 Grimshaw
5,655,614 A 8/1997 Azar
5,673,763 A 10/1997 Thorp
5,678,644 A 10/1997 Fielder
5,685,379 A 11/1997 Barr et al.
5,695,015 A 12/1997 Barr et al.
5,706,905 A 1/1998 Barr
5,720,355 A 2/1998 Lamine et al.
5,730,222 A 3/1998 Rike, Jr.
5,732,784 A 3/1998 Nelson
5,758,731 A 6/1998 Zollinger
5,762,156 A 6/1998 Bates et al.
5,778,991 A 7/1998 Runquist et al.
5,794,728 A 8/1998 Palmberg
5,803,185 A 9/1998 Barr et al.
5,803,193 A 9/1998 Krueger et al.
5,806,611 A 9/1998 Van Den Steen
5,833,002 A 11/1998 Holcombe
5,833,021 A 11/1998 Mensa-Wilmot et al.
5,839,508 A 11/1998 Tubel et al.
5,856,790 A 1/1999 Baugh et al.
5,864,058 A 1/1999 Chen
5,896,938 A 4/1999 Moeny
5,901,113 A 5/1999 Masak et al.
5,904,444 A 5/1999 Kabeuchi et al.
5,924,499 A 7/1999 Birchak et al.
5,947,215 A 9/1999 Lundell
5,950,743 A 9/1999 Cox 5,957,223 A 9/1999 Doster
5,957,225 A 9/1999 Sinor
5,965,964 A 10/1999 Skinner et al.
5,967,247 A 10/1999 Pessier
5,979,571 A 11/1999 Scott
5,992,547 A 11/1999 Caraway
5,992,548 A 11/1999 Silva
6,011,334 A 1/2000 Roland
6,021,859 A 2/2000 Tibbitts
6,030,004 A 2/2000 Schock et al.
6,039,131 A 3/2000 Beaton
6,047,239 A 4/2000 Berger et al.
6,050,350 A 4/2000 Morris et al.
6,089,332 A 7/2000 Barr et al.
6,092,610 A 7/2000 Kosmala et al.
6,123,561 A 9/2000 Turner et al.
6,131,675 A 10/2000 Anderson
6,142,250 A 11/2000 Griffin et al.
6,150,822 A 11/2000 Hong
6,186,251 B1 2/2001 Butcher
6,202,761 B1 3/2001 Forney
6,213,225 B1 4/2001 Chen
6,213,226 B1 4/2001 Eppink
6,220,079 B1 4/2001 Taylor et al.
6,223,824 B1 5/2001 Moyes
6,223,826 B1 5/2001 Chau et al.
6,253,847 B1 7/2001 Stephenson
6,269,893 B1 8/2001 Beaton
6,296,069 B1 10/2001 Lamine
6,298,930 B1 10/2001 Sinor
6,321,858 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,367,564 B1 4/2002 Mills et al.
6,382,330 B2 5/2002 Bischel et al.
6,388,346 B1 5/2002 Lopatinsky et al.
6,390,200 B1 5/2002 Allamon et al.
6,392,317 B1 5/2002 Hall et al.
6,394,200 B1 5/2002 Watson
6,419,014 B1 7/2002 Meek et al.
6,431,270 B1 8/2002 Angle
6,439,326 B1 8/2002 Huang
6,443,249 B2 9/2002 Beuershausen
6,446,728 B2 9/2002 Chau et al.
6,450,269 B1 9/2002 Wentworth et al.
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,495,929 B2 12/2002 Bosley et al.
6,510,906 B1 1/2003 Richert
6,513,606 B1 2/2003 Krueger
6,533,050 B2 3/2003 Malloy
6,550,534 B2 4/2003 Brett
6,561,289 B2 5/2003 Portman et al.
6,571,888 B2 6/2003 Comeau et al.
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Bolnan
6,619,388 B2 9/2003 Dietz et al.
6,622,803 B2 9/2003 Harvey
6,634,388 B1 10/2003 Taylor et al.
6,651,755 B1 11/2003 Kelpe
6,655,464 B2 12/2003 Chau et al.
6,668,949 B1 12/2003 Rives
6,670,880 B1 12/2003 Hall et al.
6,672,409 B1 1/2004 Dock et al.
6,688,396 B2 2/2004 Floerke et al.
6,717,283 B2 4/2004 Skinner et al.
6,717,501 B2 4/2004 Hall et al.
6,729,420 B2 5/2004 Mensa-Wilmot
6,732,817 B2 5/2004 Dewey
6,739,413 B2 5/2004 Sharp et al.
6,745,844 B2 6/2004 Henderson
6,749,031 B2 6/2004 Klemm
6,776,240 B2 8/2004 Kenison et al.
6,789,635 B2 9/2004 Wentworth et al.
6,794,777 B1 9/2004 Fradella
6,799,632 B2 10/2004 Hall et al.
6,814,162 B2 11/2004 Moran et al.
6,821,147 B1 11/2004 Hall et al.
6,822,579 B2 11/2004 Goswani
6,830,467 B2 12/2004 Hall et al.
6,844,498 B2 1/2005 Hall et al.
6,845,822 B2 1/2005 Chau
6,848,503 B2 2/2005 Schultz et al.
6,854,953 B2 2/2005 Van Drentham-Susman et al.
6,863,124 B2 3/2005 Araux et al.
6,880,648 B2 4/2005 Edscer
6,888,473 B1 5/2005 Hall et al.
6,913,093 B2 7/2005 Hall et al.
6,913,095 B2 7/2005 Krueger
6,920,930 B2 7/2005 Allamon et al.
6,929,076 B2 8/2005 Fanuel et al.
6,929,493 B2 8/2005 Hall et al.
6,945,802 B2 9/2005 Hall et al.
6,948,572 B2 9/2005 Hay et al.
6,953,096 B2 10/2005 Gledhill
6,968,611 B2 11/2005 Hall et al.
6,994,175 B2 2/2006 Egerstrom
7,013,994 B2 3/2006 Eddison
7,028,779 B2 4/2006 Chau
7,036,611 B2 5/2006 Radford et al.
7,048,078 B2 5/2006 Dewey et al.
7,073,610 B2 7/2006 Susman
7,096,980 B2 8/2006 Trevas
7,133,325 B2 11/2006 Kotsonis et al.
7,150,329 B2 12/2006 Chau
7,165,608 B2 1/2007 Schultz et al.
7,190,084 B2 3/2007 Hall et al.
7,193,526 B2 3/2007 Hall et al.
7,198,119 B1 4/2007 Hall et al.
7,201,239 B1 4/2007 Perry
7,219,747 B2 5/2007 Gleitman et al.
7,225,886 B1 6/2007 Hall
7,246,660 B2 7/2007 Fripp et al.
7,261,184 B2 8/2007 Bass et al.
7,270,196 B2 9/2007 Hall
7,308,937 B2 12/2007 Radford et al.
7,328,755 B2 2/2008 Hall et al.
7,331,397 B1 2/2008 Wagley et al.
7,337,858 B2 3/2008 Hall et al.
7,360,610 B2 4/2008 Hall et al.
7,367,397 B2 5/2008 Clemens et al.
7,398,837 B2 7/2008 Hall et al.
7,419,016 B2 9/2008 Hall et al.
7,419,018 B2 9/2008 Hall et al.
7,424,922 B2 9/2008 Hall et al.
7,426,968 B2 9/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 7/2009 Hall et al.
7,600,586 B2 10/2009 Hall et al.
7,617,886 B2 11/2009 Hall
7,624,824 B2 12/2009 Hall et al.
7,637,323 B2 12/2009 Schasteen et al.
7,641,003 B2 1/2010 Hall et al.
7,836,948 B2 * 11/2010 Kusko et al. ..... 166/249
2001/0054515 A1 12/2001 Eddison et al.
2002/0050359 A1 5/2002 Eddison
2002/0135179 A1 9/2002 Boyle et al.
2002/0162654 A1 11/2002 Bauer et al.
2003/0042812 A1 3/2003 Post
2003/0116969 A1 6/2003 Skinner et al.
2003/0192449 A1 10/2003 Fiske et al.
2003/0213598 A1 11/2003 Hughes
2003/0213621 A1 11/2003 Britten 2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0173381 A1* 9/2004 Moore et al. ..... 175/76
2004/0182366 A1 9/2004 Andersson et al.
2004/0216847 A1 11/2004 Hall et al.
2004/0222024 A1 11/2004 Edscer
2004/0238221 A1 12/2004 Runia
2004/0244916 A1 12/2004 Hall et al.
2004/0244964 A1 12/2004 Hall et al.
2004/0246142 A1 12/2004 Hall et al.
2004/0256153 A1 12/2004 Helms et al.
2004/0256155 A1 12/2004 Kriesels
2005/0001735 A1 1/2005 Hall et al.
2005/0001736 A1 1/2005 Hall et al.
2005/0001738 A1 1/2005 Hall et al.
2005/0011678 A1 1/2005 Akinlade et al.
2005/0024231 A1 2/2005 Fincher et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0115718 A1 6/2005 Symons et al.
2005/0139393 A1 6/2005 Maurer et al.
2005/0145406 A1 7/2005 Hall et al.
2005/0145417 A1 7/2005 Radford et al.
2005/0150653 A1 7/2005 Hall et al.
2005/0155450 A1 7/2005 Jennings
2005/0161215 A1 7/2005 Hall et al.
2005/0173128 A1 8/2005 Hall et al.
2005/0211471 A1* 9/2005 Zupanick ..... 175/57
2005/0212530 A1 9/2005 Hall et al.
2005/0236160 A1 10/2005 Hall et al.
2005/0284662 A1 12/2005 Hall et al.
2006/0016606 A1 1/2006 Tubel et al.
2006/0034154 A1 2/2006 Perry et al.
2006/0117759 A1 6/2006 Hall et al.
2006/0243455 A1 11/2006 Telfer et al.
2006/0243493 A1* 11/2006 El-Rayes et al. ..... 175/107
2006/0260797 A1 11/2006 Hall et al.
2006/0260798 A1 11/2006 Hall et al.
2006/0260801 A1 11/2006 Hall et al.
2007/0017671 A1 1/2007 Clark et al.
2007/0017679 A1 1/2007 Wolf et al.
2007/0056724 A1 3/2007 Spring et al.
2007/0062706 A1 3/2007 Leising
2007/0079988 A1 4/2007 Konschuh et al.
2007/0107944 A1 5/2007 Lee
2007/0194948 A1 8/2007 Hall et al.
2007/0242565 A1 10/2007 Hall et al.
2007/0251696 A1 11/2007 Parks
2008/0041597 A1 2/2008 Fisher et al.
2008/0105464 A1 5/2008 Radford
2008/0217024 A1 9/2008 Moore
2008/0296015 A1 12/2008 Hall et al.
2009/0044951 A1 2/2009 Milkovisch et al.
2009/0056497 A1 3/2009 Swinford
2009/0126936 A1 5/2009 Begley et al.
2009/0166086 A1 7/2009 Sugiura
2010/0132954 A1 6/2010 Telfer
2011/0120725 A1 5/2011 Downton et al.
2011/0278017 A1 11/2011 Themig et al.

OTHER PUBLICATIONS

Paten Cooperation Treaty, International Preliminary Report on Patentability, International Search Report and Written Opinion of the International Searching Authority for PCT/US06/43107, date of mailing Mar. 5, 2007.

Paten Cooperation Treaty, International Preliminary Report on Patentability and Written Opinion of the International Searching Authority for PCT/US06/43125, date of mailing Jun. 4, 2007; and the International Search Report, dated Feb. 23, 2007.

* cited by examiner

DOWNHOLE TURBINE

CROSS REFERENCE TO RELATED APPLICATIONS

This patent application is a continuation of U.S. patent application Ser. No. 12/262,372 filed on Oct. 31, 2008 and which is now U.S. Pat. No. 7,730,972 issued on Jun. 8, 2010, which is a continuation-in-part of U.S. patent application Ser. No. 12/178,467 filed on Jul. 23, 2008 and which is now U.S. Pat. No. 7,730,975 issued on Jun. 8, 2010 which is a continuation-in-part of U.S. patent application Ser. No. 12/039,608 filed on Feb. 28, 2008 and which is now U.S. Pat. No. 7,762,353 issued on Jul. 27, 2010 which is a continuation-in-part of U.S. patent application Ser. No. 12/037,682 filed on Feb. 26, 2008 and which is now U.S. Pat. No. 7,624,824 issued on Dec. 1, 2009 which is a is a continuation-in-part of U.S. patent application Ser. No. 12/019,782 filed on Jan. 25, 2008 and which is now U.S. Pat. No. 7,617,886 issued on Nov. 17, 2009, which is a continuation-in-part of U.S. patent application Ser. No. 11/837,321 filed on Aug. 10, 2007 and which is now U.S. Pat. 7,559,379 issued on Jul. 14, 2009, which is a continuation-in-part of U.S. patent application Ser. No. 11/750,700 filed on May 18, 2007 and which is now U.S. Pat. No. 7,549,489 issued on Jun. 23, 2009. U.S. patent application Ser. No. 11/750,700 is a continuation-in-part of U.S. patent application Ser. No. 11/737,034 filed on Apr. 18, 2007 and which is now U.S. Pat. No. 7,503,405 issued on Mar. 17, 2009. U.S. patent application Ser. No. 11/737,034 is a continuation-in-part of U.S. patent application Ser. No. 11/686,638 filed on Mar. 15, 2007 and which is now U.S. Pat. No 7,424,922 issued on Sep. 16,2008. U.S. patent application Ser. No. 11/686,638 is a continuation-in-part of U.S. patent application Ser. No. 11/680,997 filed on Mar. 1, 2007 and which is now U.S. Pat. No. 7,419,016 issued on Sep. 2, 2008. U.S. patent application Ser. No. 11/680,997 is a continuation in-part of U.S. patent application Ser. No. 11/673,872 filed on Feb. 12, 2007 and which is now U.S. Pat. No. 7,484,576 issued on Feb. 3, 2009. U.S. patent application Ser. No. 11/673,872 is a continuation in-part of U.S. patent application Ser. No. 11/611,310 filed on Dec. 15, 2010 and which is now U.S. Pat. No. 7,600,586 issued on Oct. 13, 2009. U.S. patent application Ser. No. 12/039,608 is also a continuation-in-part of U.S. patent application Ser. No. 11/278,935 filed on Apr. 6, 2006 and which is now U.S. Pat. No. 7,426,968 issued on Sep. 23, 2008. U.S. patent application Ser. No. 11/278,935 is a continuation-in-part of U.S. patent application Ser. No. 11/277,394 filed on Mar. 24, 1996 and which is now U.S. Pat. No. 7,398,837 issued on Jul. 15, 2008. U.S. patent application Ser. No. 11/277,294 is a continuation-in-part of U.S. patent application Ser. No. 11/277,380 filed on Mar. 24, 2006 and which is now U.S. Pat. No. 7,337,858 issued on Mar. 4, 2008. U.S. patent application Ser. No. 11/277,380 is a continuation-in-part of U.S. patent application Ser. No. 11/306,976 filed on Jan. 18, 2006 and which is now U.S. Pat. No. 7,360,610 issued on Apr. 22, 2008. U.S. patent application Ser. No. 11/306,976 is a continuation-in-part of U.S. patent application Ser. No. 11/306,307 filed on Dec. 22, 2005 and which is now U.S. Pat. No. 7,225,886 issued on Jun. 5, 2007. U.S. patent application Ser. No. 11/306,307 is a continuation in-part of U.S. patent application Ser. No. 11/306,022 filed on Dec. 14, 2005 and which is now U.S. Pat. No. 7,198,119 issued on Apr. 3, 2007. U.S. patent application Ser. No. 11/306,022 is a continuation-in-part of U.S. patent application Ser. No. 11/164,391 filed on Nov. 21, 2005 and which is now U.S. Pat. No. 7,270,196 issued on Sep. 18, 2007. U.S patent application Ser. No. 12/039,608 is also a continuation in-part of U.S. patent application Ser. No. 11/555,334 which was filed on Nov. 1, 2006 and which is now U.S Pat. No. 7,419,018 issued on Sep 2, 2008. All of these applications are herein incorporated by reference in their entirety.

BACKGROUND

This invention relates to the field of percussive tools used in drilling. More specifically, the invention is directed to a downhole turbine coupled to a downhole jack element which may be actuated by drilling fluid.

The prior art has addressed the operation of a downhole hammer actuated by drilling mud. Such operations have been addressed in the U.S. Pat. No. 7,073,610 to Susman, which is herein incorporated by reference for all that it contains. The '610 patent discloses a downhole tool for generating a longitudinal mechanical load. In one embodiment, a downhole hammer is disclosed which is activated by applying a load on the hammer and supplying pressurizing fluid to the hammer. The hammer includes a shuttle valve and piston that are moveable between first and farther position, seal faces of the shuttle valve and piston being released when the valve and the piston are in their respective farther positions, to allow fluid flow through the tool. When the seal is releasing, the piston impacts a remainder of the tool to generate mechanical load. The mechanical load is cyclical by repeated movements of the shuttle valve and piston.

U.S. Pat. No. 6,994,175 to Egerstrom, which is herein incorporated by reference for all that it contains, discloses a hydraulic drill string device that can be in the form of a percussive hydraulic in-hole drilling machine that has a piston hammer with an axial through hole into which a tube extends. The tube forms a channel for flushing fluid from a spool valve and the tube wall contains channels with ports cooperating with the piston hammer for controlling the valve.

U.S. Pat. No. 4,819,745 to Walter, which is herein incorporated by reference for all that it contains, discloses a device placed in a drill string to provide a pulsating flow of the pressurized drilling fluid to the jets of the drill bit to enhance chip removal and provide a vibrating action in the drill bit itself thereby to provide a more efficient and effective drilling operation.

BRIEF SUMMARY

In one aspect of the present invention a drill bit has a jack element that is substantially coaxial with an axis of rotation of the drill bit and the jack element has an asymmetrical distal end that extends beyond a working face of the drill bit. A turbine is located within a bore formed in the drill bit and a flow valve is actuated by the turbine. The flow valve is adapted to route a drilling fluid in the bore into a porting mechanism adapted to extend the jack element farther beyond the working surface of the drill bit. The turbine is also adapted to rotate the jack element at variable speeds.

A first gear box disposed intermediate the turbine and the jack element may be adapted to transfer torque from a drive shaft of the turbine to the jack element. A second gear box disposed intermediate the turbine and the porting mechanism may be adapted to transfer torque from a drive shaft of the turbine to the flow valve.

A flow guide may be disposed between a plurality of blades of the turbine and a wall of the bore and may be adapted to guide the flow of drilling fluid across the turbine. A first end of the flow guide may have a diameter larger than a diameter of a second end of the flow guide. The flow guide may have a tapered interior surface. An actuator disposed within the bore may be adapted to move the flow guide along a central axis of the drill bit towards and away from a bottom end of the turbine. The actuator may be a solenoid valve, an aspirator, a hydraulic piston, a pump, a dc motor, an ac motor, a rack and pinion, or combinations thereof.

The turbine may actuate an electrical generator disposed proximate the drill bit. The turbine may rotate the jack element in a direction opposite to a direction of rotation of the drill bit. Sensors disposed proximate magnets connected to the jack element may be adapted to detect the orientation of the jack element and a rotational speed of the jack element. The porting mechanism may be adapted to oscillate the jack element extending the jack element farther beyond the working surface of the drill bit and back again. The jack element may have a bearing, a bushing, or a combination thereof The porting mechanism may have a piston adapted to extend the jack element beyond the working surface of the drill bit. The flow valve may be adapted to route the drilling fluid in the porting mechanism out of the porting mechanism and toward a formation. The turbine may be disposed in a component of a drill string in communication with the drill bit. The drill bit may be in communication with a telemetry network.

A method for steering a drill bit through a formation may use the steps of providing a jack element substantially coaxial with an axis of rotation of the drill bit, the jack element comprises an asymmetrical distal end extending beyond a working face of the drill bit, a turbine located within a bore formed in the drill bit and adapted to rotate the jack element at variable speeds, a porting mechanism adapted to extend the jack element farther beyond the working surface of the drill bit, and a flow valve actuated by the turbine; directing a drilling fluid flow across the turbine; actuating a flow valve such that the drilling fluid is directed into the porting mechanism; extending the jack element and the asymmetrical tip of the jack element farther beyond the working surface of the drill bit; and rotating the asymmetrical tip of the jack element to a desired orientation.

In another aspect of the invention, a pipe segment includes a turbine located within a bore of a the pipe segment and a mechanism is disposed within the bore that is adapted to change the rotational speed of the turbine. The pipe segment may be a component of a drill string, tool string, production string, pipeline, drill bit, or combinations thereof. The change in rotational speed may be detected anywhere within the bore of the drill string, tool string, production string, and/or pipeline due to a fluid pressure change within the bore. The change of fluid pressure may be used for communication along the drill string, tool string, production string, and/or pipeline.

The mechanism may be a flow guide that controls the amount of fluid that engages the turbine blades. In other embodiments, the mechanism is adapted to change an engagement angle of the turbine blades and/or stators associated with the turbine.

DETAILED DESCRIPTION

Figure 1:
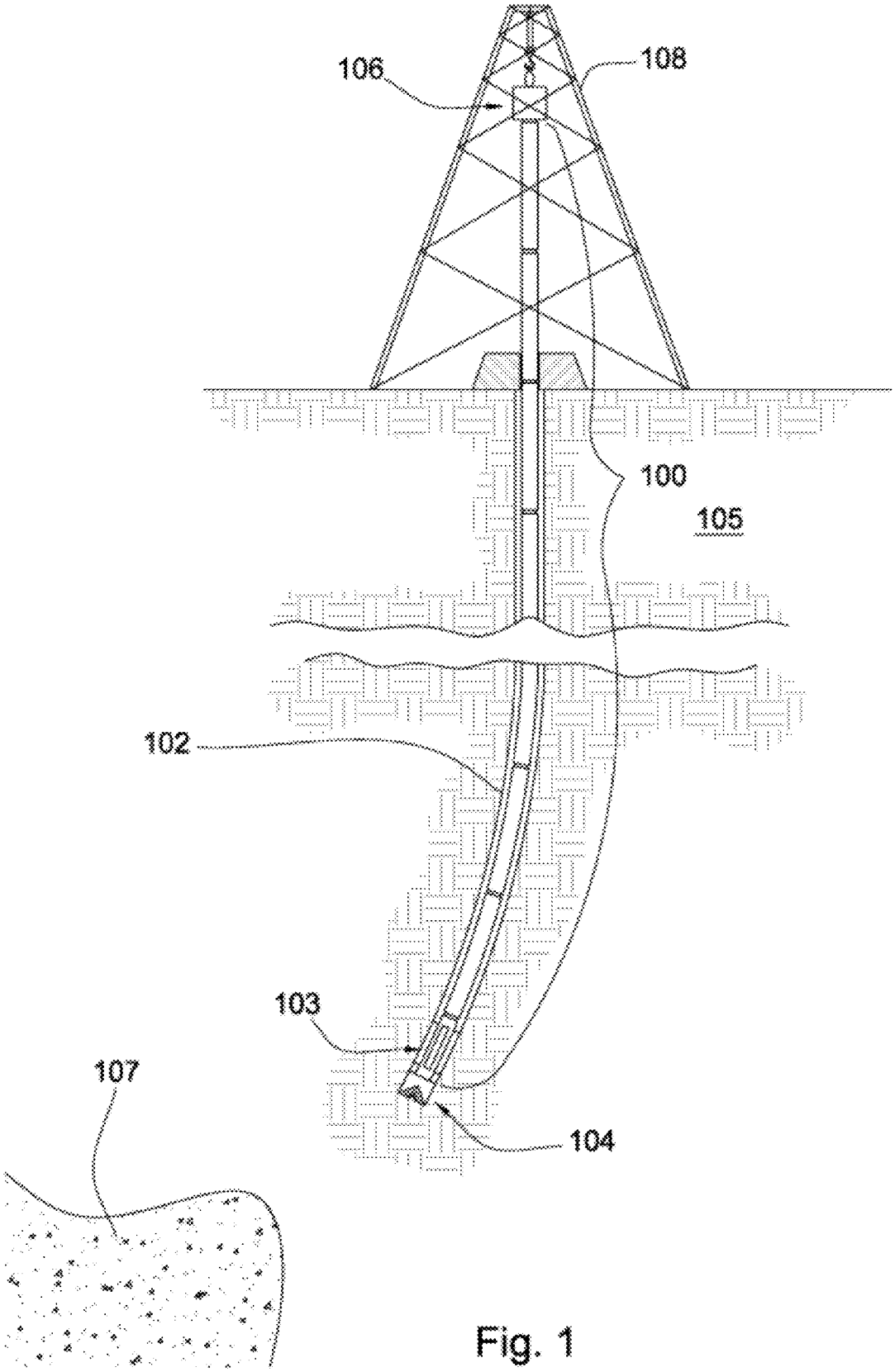
FIG. 1 is a cross-sectional diagram of an embodiment of a drill string suspended in a bore hole.
Figure 2:
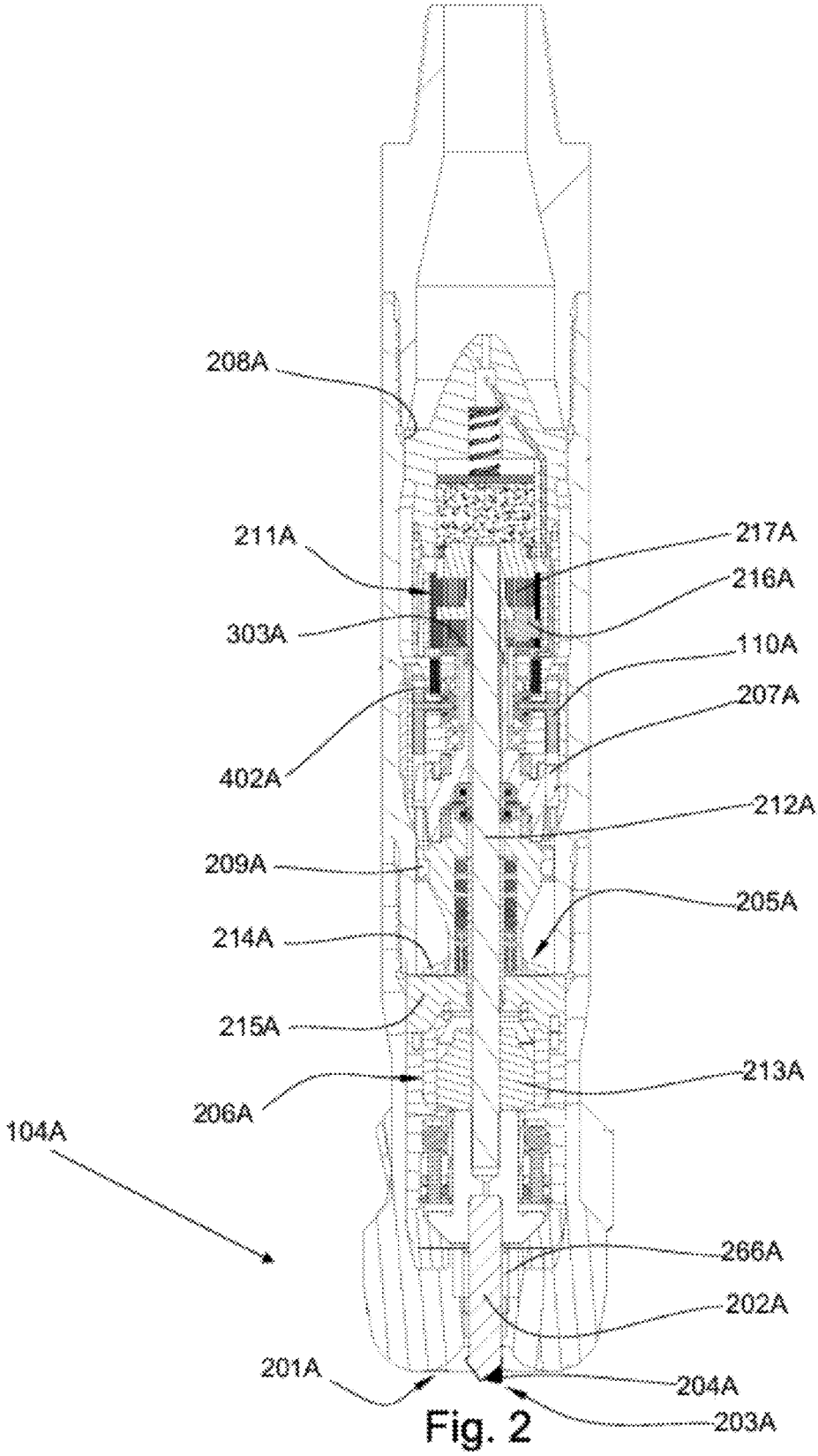
FIG. 2 is a cross-sectional diagram of an embodiment of a drill bit.

FIG. 1 is a perspective diagram of an embodiment of a drill string 100 suspended by a derrick 108 in a bore hole 102. A drilling assembly 103 is located at the bottom of the bore hole 102 and includes a drill bit 104. As the drill bit 104 rotates downhole the drill string 100 advances farther into the earth. The drill string 100 may penetrate soft or hard subterranean formations 105. The drilling assembly 103 and/or downhole components may comprise data acquisition devices adapted to gather data. The data may be sent to the surface via a transmission system to a data swivel 160. The data swivel 106 may send the data to the surface equipment. Furthermore, the surface equipment may send data and/or power to downhole tools, the drill bit 104 and/or the drilling assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop.

Referring now to the embodiment of FIG. 2-4*c*, a drill bit 104A includes a jack element 202A substantially coaxial with an axis of rotation of the drill bit 104A. The jack element 202A has an asymmetrical distal end 203A extending beyond a working surface 201A of the drill bit 104A. The asymmetrical distal end 203A may include a conical diamond tip 204A. U.S. patent application Ser. No. 12/051,689 to Hall, which is herein incorporated by reference for all that it contains, discloses a conical diamond tip that may be compatible with the present invention. The jack element 202A is adapted to rotate relative to the drill bit 104A. A bushing 266A may be disposed between the jack element 202A and the drill bit 104A and adapted to reduce frictional wear on the jack element 202A.

A turbine 207A is located within a bore 208A formed in the drill bit 104A and is adapted to rotate the jack element 202A. A first gear box 211A may be disposed in the bore 208A and may be adapted to transfer torque from a drive shaft 303A of the turbine 207A to the jack element 202A. The first gear box 211A may transfer torque to the jack element 202A via a drive rod 212A. The drive rod 212A of the first gear box 211A may extend through an entire length of the drive shaft 303A of the turbine 207A and along a central axis of the drive shaft 303A of the turbine 207A. The first gear box 211A may comprise a first set of planetary gears 216A adapted to transfer torque from the drive shaft 303A of the turbine 207A to the drive rod 212A of the first gear box 211A. The first gearbox 211A may reduce the magnitude of the torque transferred from the drive shaft 303A to the drive rod 212A. In some embodiments, the set of planetary gears 216A transfers a quarter of the torque from the drive shaft 303A to the drive rod 212A. The first gear box 211A may further comprise a second set of planetary gears 217A adapted to reduce the magnitude of the torque transferred from the first set of planetary gears 216A to the drive rod 212A of the first gear box 211A. In some embodiments, the second set of planetary gears 217A may transfer a quarter of the torque from the set of planetary gears 216A to the drive rod 212A of the first gear box 211A. The turbine 207A may rotate the jack element 202A in a direction opposite to a direction of rotation of the drill bit 104A. By adapting the turbine 207A to rotate the jack element 202A in a direction opposite to a direction of rotation of the drill bit 104A the asymmetrical distal end 203A of the jack element 202A will remain rotationally stationary with regards to a formation and may direct the drill bit 104A and thus a drill string in a preferred direction through the formation.

The drill bit 104A may also include a flow valve 205A adapted to route a drilling fluid in the bore 208A into a porting mechanism 206A disposed in the drill bit 104A. The flow valve 205A may comprise a first disc 214A and second 215A disc that may be substantially contacting each other along a substantially flat interface that is substantially normal to an axis of rotation of the first disc 214A. The first disc 214A may have blades 209A which may be adapted to rotate the first disc 214A with respect to the second disc 111A as the drilling fluid flows across the blades 209A. The first disc 214A may have a first set of ports (not illustrated) adapted to align and misalign with a second set of ports (not illustrated) of the second disc 215A. The porting mechanism 206A is adapted to extend the jack element 202A farther beyond the working surface 201A of the drill bit 104A. The porting mechanism 206A may include a piston 213A adapted to extend the jack element 202A farther beyond the working surface 201A of the drill bit 104A. The porting mechanism 206A may be adapted to oscillate the jack element 202A extending the jack element 202A farther beyond the working surface 201A of the drill bit 104A and back again. The flow valve 205A may direct the drilling fluid into the porting mechanism 206A and beneath the piston 213A. The pressure of the drilling fluid between the piston 213A and the jack element 202A thereby lifts the piston 213A towards the turbine 207A. The flow valve 205A may be adapted to route the drilling fluid in the porting mechanism 206A out of the porting mechanism 206A and toward the formation thereby allowing the piston 213A to lower towards the jack element 202A and extend the jack element 202A farther beyond the working surface 201A of the drill bit 104A. Oscillating the jack element 202A, extending the jack element 202A farther beyond the working surface 201A of the drill bit 104A and back again, while the working surface 201A of the drill bit 104A is adjacent to the formation may allow the jack element 202A to degrade the formation 105A. An embodiment of a flow valve and an embodiment of a porting mechanism that may be compatible with the present invention is disclosed in U.S. patent application Serial No. 12/178,467 to Hall, which is herein incorporated by reference for all that it contains.

Figure 3:
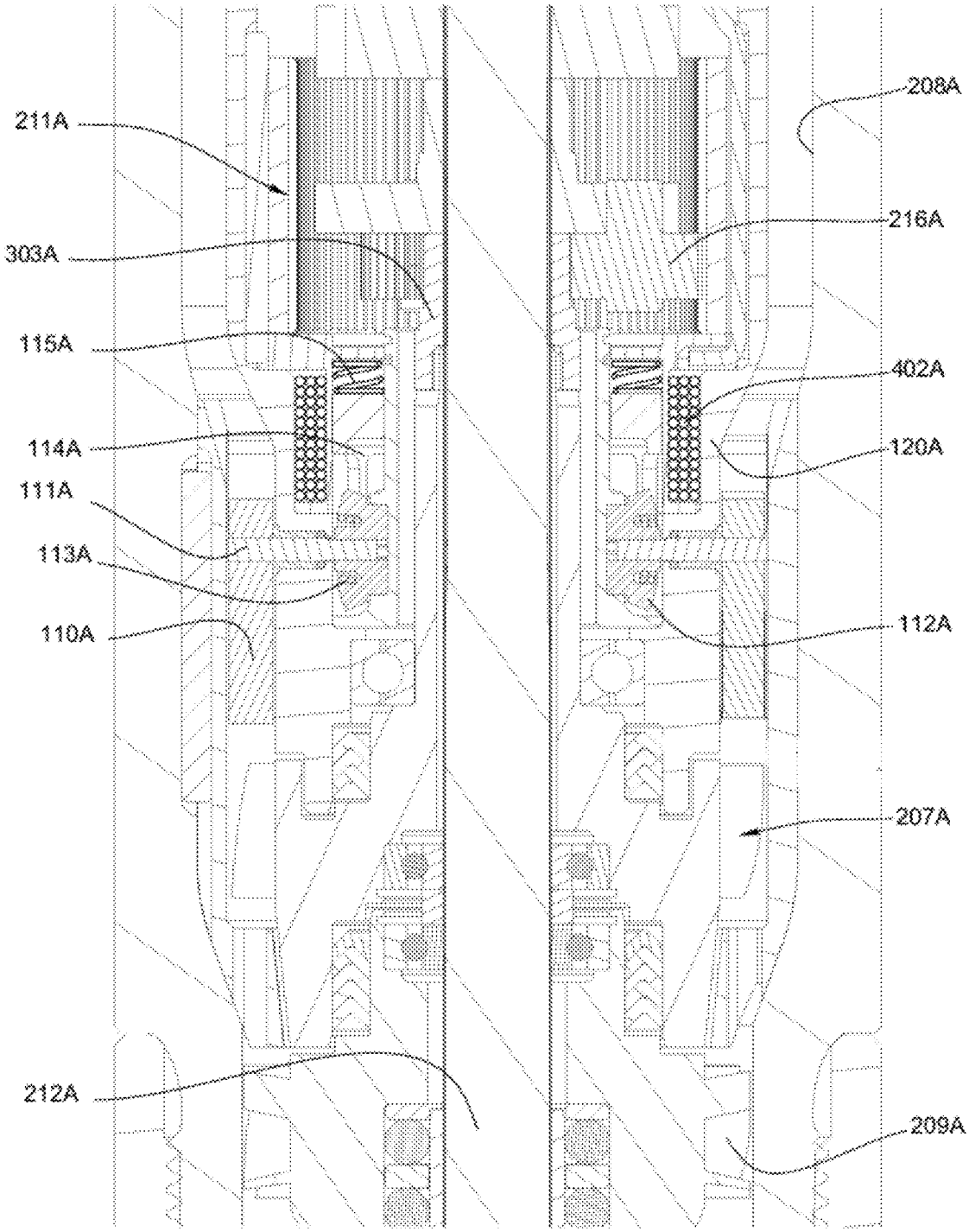
FIG. 3 is a cross-sectional diagram of an embodiment of a turbine and an adjustable stator disposed in a drill bit.
Figure 4A:
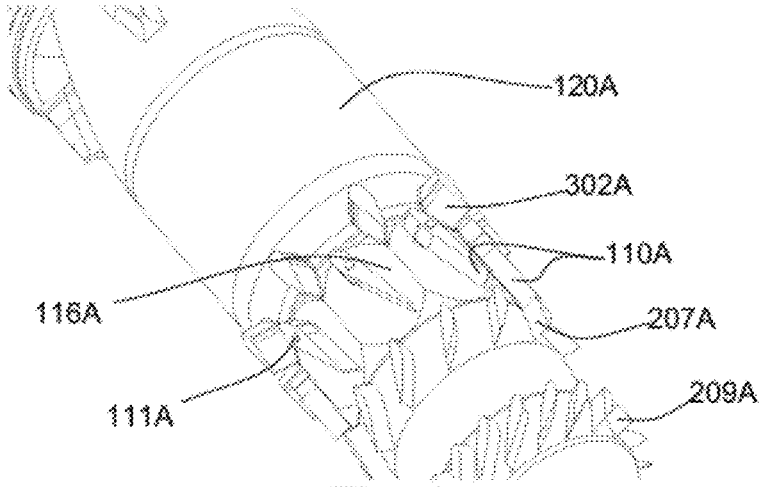
FIG. 4*a* is a perspective diagram of an embodiment of a turbine and an adjustable stator disposed in a drill bit.
Figure 4B:
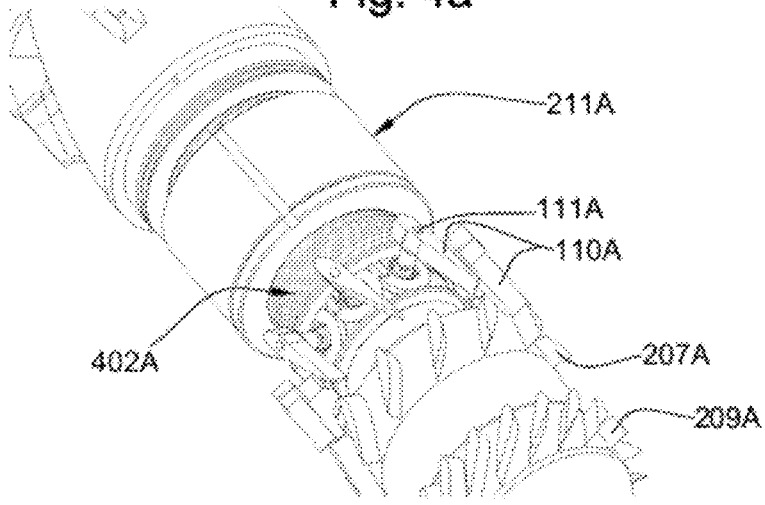
FIG. 4*b* is a perspective diagram of an embodiment of a turbine and an adjustable stator disposed in a drill bit.
Figure 4C:
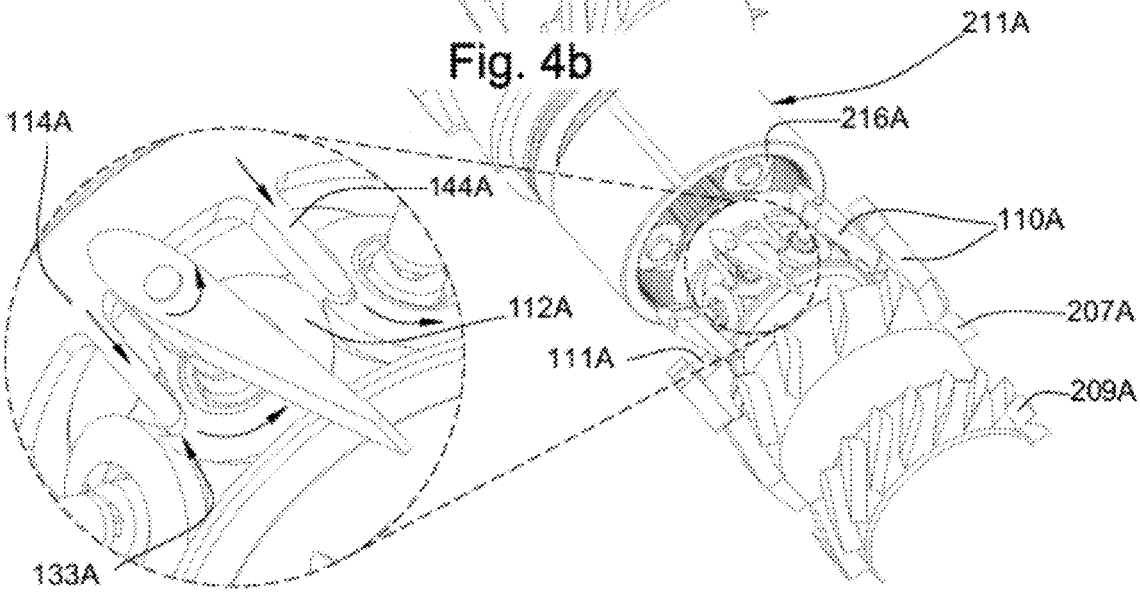
FIG. 4*c* is a perspective diagram of an embodiment of a turbine and an adjustable stator disposed in a drill bit.
Figure 5:
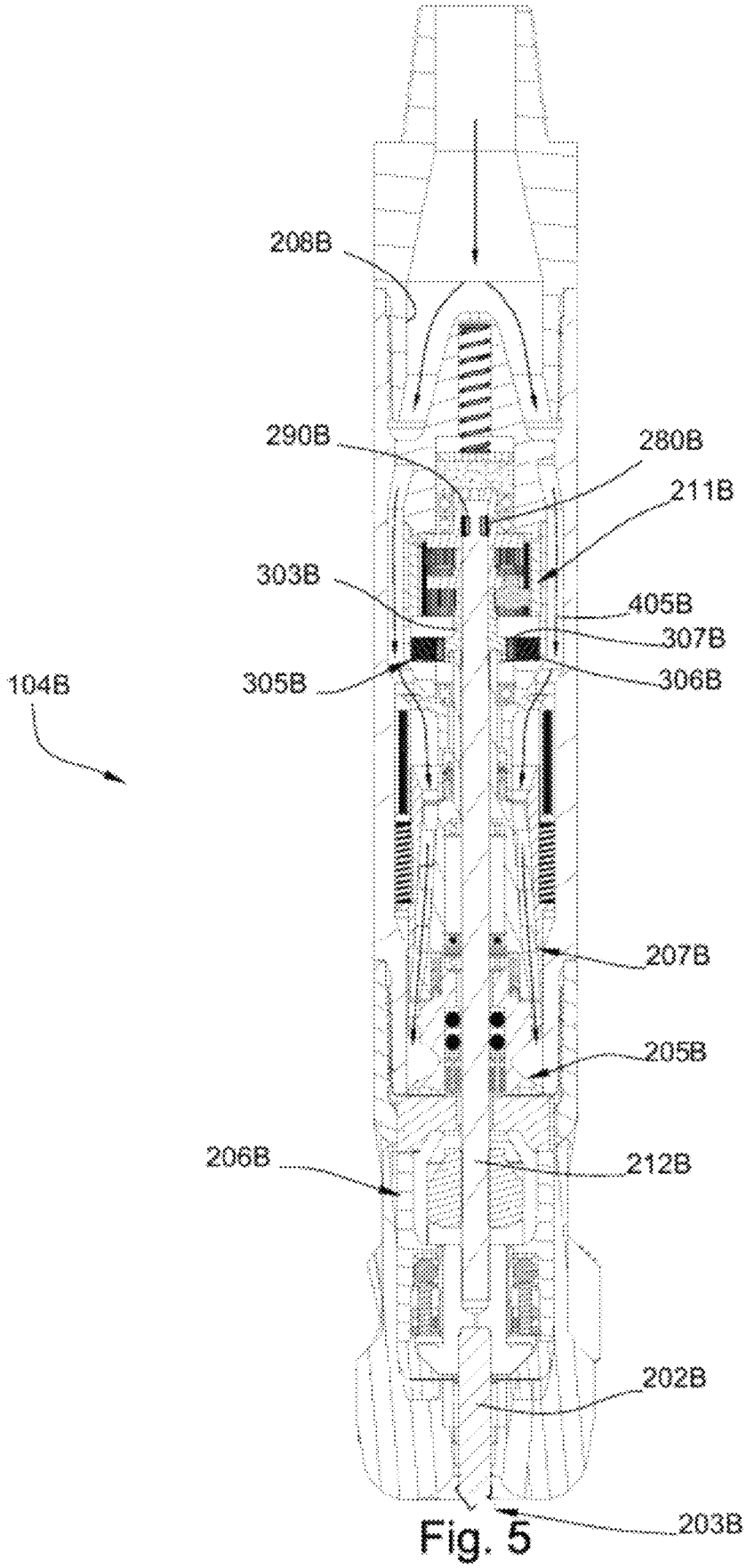
FIG. 5 is a cross-sectional diagram of another embodiment of a drill bit.
Figure 6:
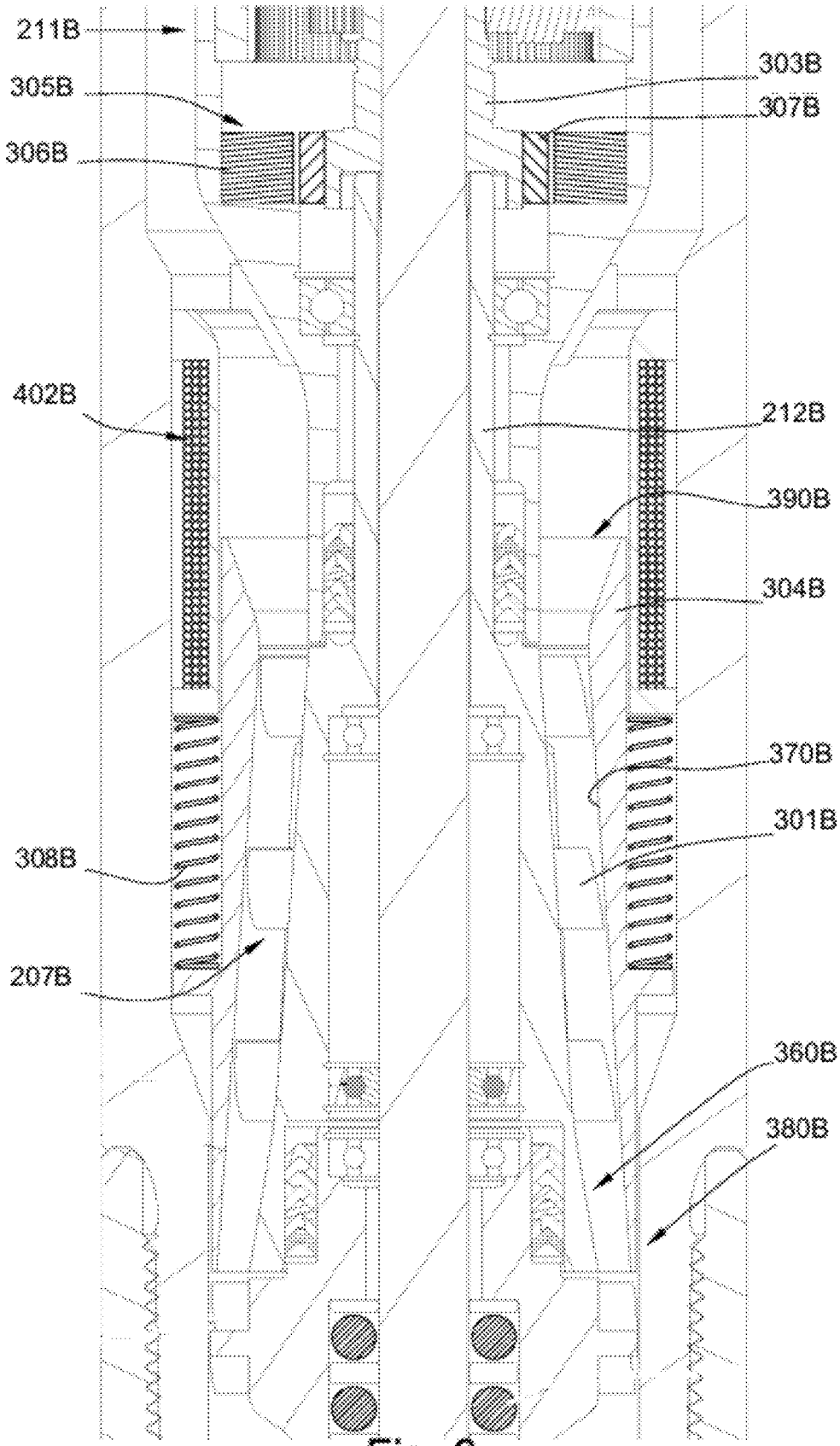
FIG. 6 is a cross-sectional diagram of an embodiment of a turbine and a flow guide disposed in a drill bit.
Figure 7A:
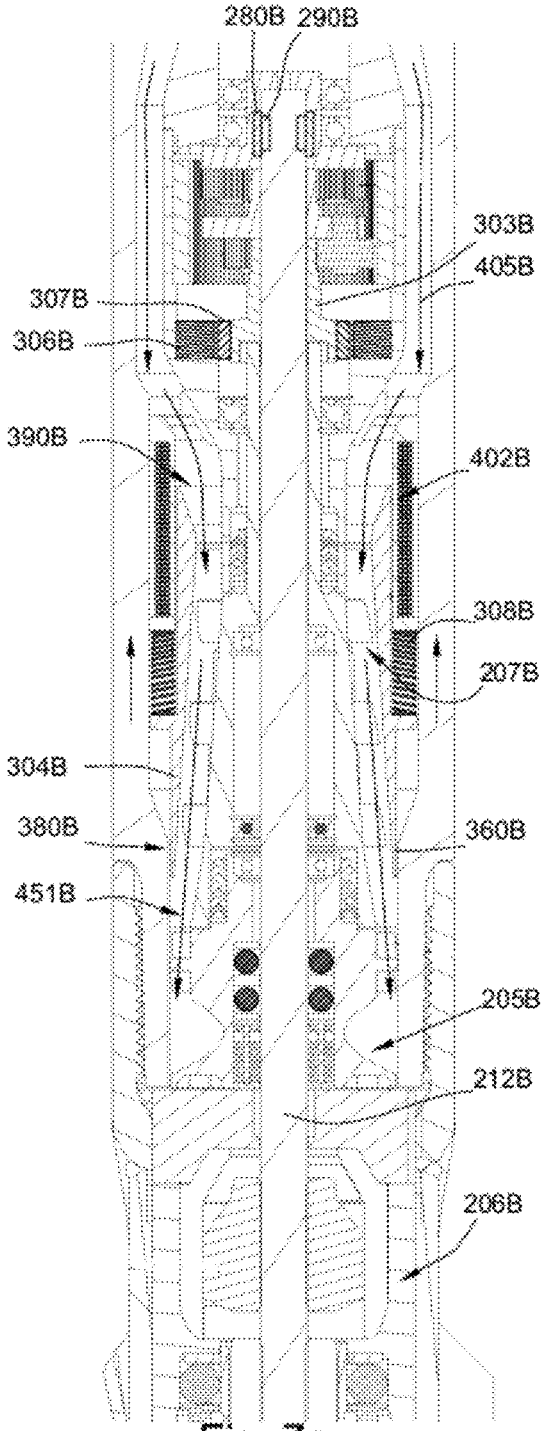
FIG. 7*a* is a cross-sectional diagram of an embodiment of a flow guide, an actuator and a turbine disposed in a drill bit.
Figure 7B:
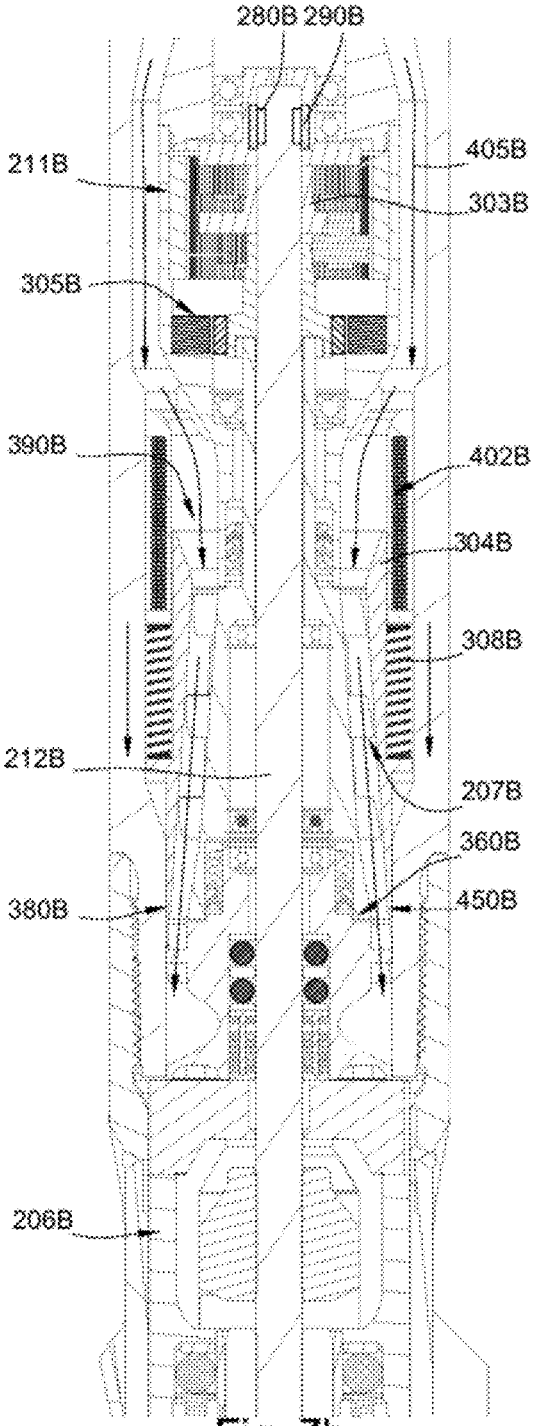
FIG. 7*b* is a cross-sectional diagram of another embodiment of a flow guide, an actuator and a turbine disposed in a drill bit.

Continuing with to FIGS. 3 through 4*c*, at least one movable stator 110A may be disposed in the bore 208A, which is capable of changing omits engagement angle with the fluid in the bore 208A. The at least one movable stator 110A may be connected to a pin arm 111A that is adapted to pivot. An actuator 402A may be disposed in the bore 208A and may be adapted to adjust the position of the at least one movable stator 110A. The actuator 402A may be a solenoid, a solenoid valve, an aspirator, a hydraulic piston, a pump, a dc motor, an ac motor, a rack and pinion, a lever, a hammer, a spring or combinations thereof. In the embodiment disclosed in FIGS. 3 through 4*c*, the actuator 402A comprises is a solenoid 402A adapted to create a magnetic field within the bore 208A, at least one lever 112A, and a hammer 114A. The at least one lever 112A is connected rigidly to the pin arm 111A opposite the at least one movable stator 110A and is adapted to transfer torque to the pin arm 111. The at least one lever 112A may comprise a catch 133A. The hammer 114A may be disposed proximate the at least one solenoid 402A and may have at least one flange 144A adapted to fit against the catch 133A of the at least one lever 112A. At least one spring 115A may be disposed intermediate the first gear box 211A and the hammer 114A and may be adapted to push the hammer 114A against the at least one lever 112A. A preloaded torsion spring 113A may be disposed in the at least one lever 112A and may be adapted to force the catch 133A of the at least one lever 112A against the at least one flange 144A. By adjusting the position of the movable stator 110A the angle at which the drilling fluid engages the blades of the turbine 207A is changed. Furthermore, by adjusting the angle at which the drilling fluid engages the blades of the turbine 207A the rotational speed of the turbine 207A may be adjusted. The at least one stator 110A may be moved by activating the solenoid 402A. As the solenoid 402A is activated, the solenoid 402 attracts the hammer 114A magnetically pulling the hammer 114A towards the first gear box 211A thereby compressing the at least one spring 115A. The preloaded torsion springs 113A continue to force the catch 133A of the at least one lever 112A against the at least one flange 144A of the hammer 114A by turning the at least one lever 112A. As the at least one lever 112A turns, the at least one lever 112A transfers torque to the pin arm 111A which moves the at least one movable stator 110A in a direction in which the preloaded torsion spring 113A is acting. As the solenoid 402A is deactivated the at least one spring 115A pushes the at least one flange 144A of the hammer 114A against the catch 133A of the at least one lever 112A turning the at least one lever 112A and compressing the preloaded torsion spring 113A. As the at least one lever 112A turns and the preloaded torsion spring 113A is compressed, torque is transferred to the pin arm 111 and the at least one movable stator 110A is moved in a direction opposing the direction in which the preloaded torsion spring 11A3 is acting. In some embodiments, this mechanism may be used to alter the engagement angle of the turbine blades.

The at least one lever 112A, the solenoid 402A, the hammer 114A, the preloaded torsion spring 113A, and the at least one spring 115A may be disposed inside a casing 120A of the first gear box 211A. The at least one movable stator 110A may be disposed between an inner surface of the bore 208A and the casing 120A of the first gear box 211A and the pin arm 111A may extend through the casing 120A of the first gear box 211A. FIG. 4*a* illustrates the embodiment wherein the casing 120A of the first gear box 211A is visible. FIG. 4*b* illustrates a view of the same embodiment wherein the casing 120A of the first gear box 211A has been removed. FIG. 4C illustrates a view of the same embodiment wherein the casing 120A of the first gear box 211 and the solenoid 402A have been removed. The casing 120A of the first gear box 211A may have flat surfaces 116A disposed adjacent each of the at least one movable stators 110A and the flat surfaces 116A are adapted to allow the at least one movable stators 110A to maintain full contact with the casing 120A of the first gear box 211A while the at least one movable stators 110A move.

Referring now to the embodiment of drill bit 104B shown in FIGS. 5 through 7*b*, sensors 280B may be disposed proximate magnets 290B connected to a drive rod 212B of a first gear box 211B that transfers torque to a jack element 202B and the sensors 280B may be adapted to detect the orientation of the jack element 202B and the rotational speed of the jack element 202B. The magnets 290B may also be connected to the jack element 202B and the sensors 280B may be disposed proximate the magnets 290B connected to the jack element 202B. The sensors 280B may send data on the orientation and rotational speed of the jack element 202B to the surface via a telemetry system. A turbine 207B may be adapted to actuate an electrical generator 305B disposed in a bore 208B of the drill bit 104B . A magnet 307B of the electrical generator 305B may be connected to a drive shaft 303B of the turbine 207B and a conductive coil 306B of the electrical generator 305B may be rotationally fixed. The electrical generator 305B may be disposed in a hydrostatic environment within the bore 208B. A polymer coating may be disposed around the conductive coil 306B and may isolate the conductive coil 306B from the hydrostatic environment. The polymer coating may include polyimide, Teflon-FEP, Teflon-PTFE, Teflon-PFA , Teflon-AF, or combinations thereof A flow guide 304B may be disposed between a plurality of blades 301B of the turbine 207B and inner surface of the bore 208 and may be adapted to guide the flow of drilling fluid 405B across the turbine 207B. A first end 380B of the flow guide 304B may have an inside diameter larger than an inside diameter of a second end 390B of the flow guide 304B. The flow guide 304B may have a tapered interior surface 370B. An actuator 402B may be disposed in the bore 208B and adapted to move the flow guide 304B along a central axis of the drill bit 104B towards and away from a bottom end 360B of the turbine 207B. In the embodiment disclosed in F*igs*. 7*a* and 7*b*, the actuator 402B is a solenoid 402B adapted to create a magnetic field within the bore 208B. As the solenoid 402B is activated the magnetic field of the solenoid 402B may attract the flow guide 304B and move the flow guide 304B away from the bottom end 360B of the turbine 360B. As the flow guide 304B moves away from the bottom end 360B of the turbine 360B a flow space across the turbine 207B may increase decreasing the velocity 451B of the drilling fluid 405B across the turbine 207B and decreasing the rotational speed of the turbine 207B. As the solenoid 402B is deactivated, springs 308B in communication with the flow guide 304B may move the flow guide 304B towards the bottom end 360B of the turbine 207B. As the flow guide 304B moves towards the bottom end 360B of the turbine 207B, the flow guide 304B may restrict 450B the flow space across the turbine 207B increasing the velocity 451B of the drilling fluid 405B across the turbine 207B and increasing the rotational speed of the turbine 207B. By manipulating the rotational speed of the turbine 207B, decreasing the rotational speed of the turbine 207B and increasing the rotational speed of the turbine 207B, that the turbine 207B may be able to rotate the flow valve 205B and the jack element 202B at variable speeds. The asymmetrical distal end 203B may also be adjusted to a desired position by adjusting the position of the flow guide 304B so as to increase or decrease a rotational speed of the turbine 207B and the rotational speed of the jack element 202B. Adjusting the rotational speed of the flow valve 205B may adjust the rate at which the porting mechanism 206B extends the jack element 202B farther beyond the working surface 201B of the drill bit 104B and back again.

Figure 8A:
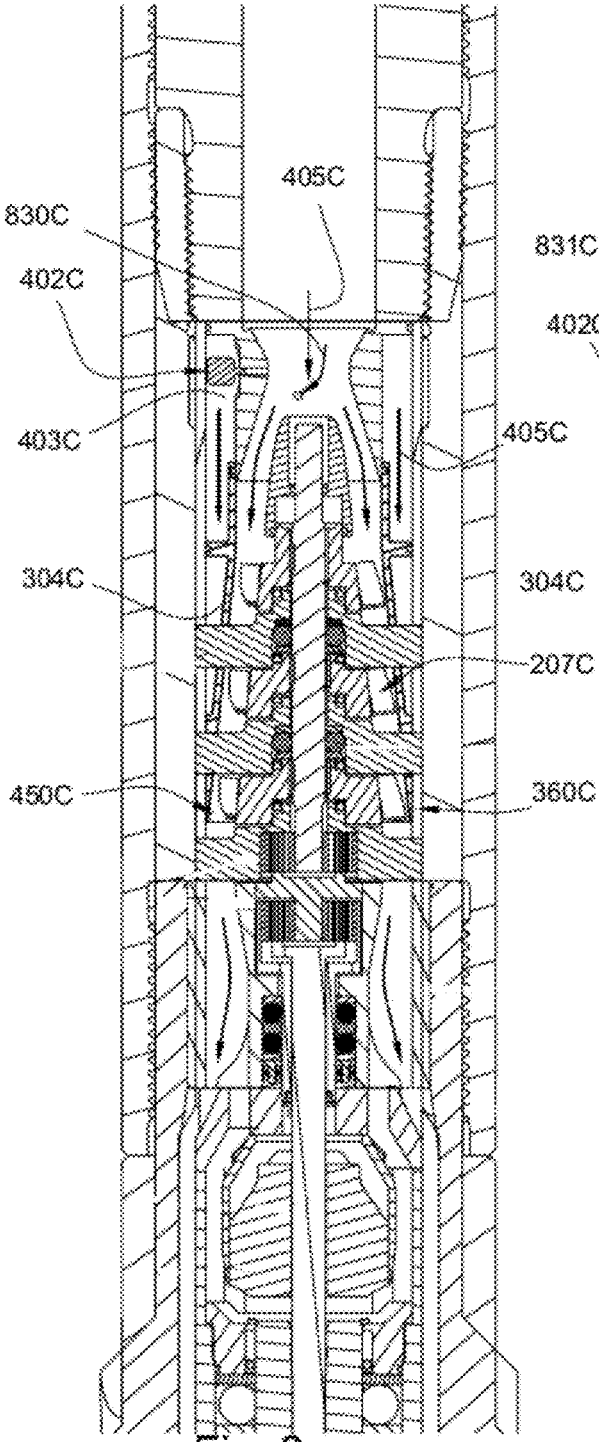
FIG. 8*a* is a cross-sectional diagram of another embodiment of a flow guide, an actuator and a turbine disposed in a drill bit.
Figure 8B:
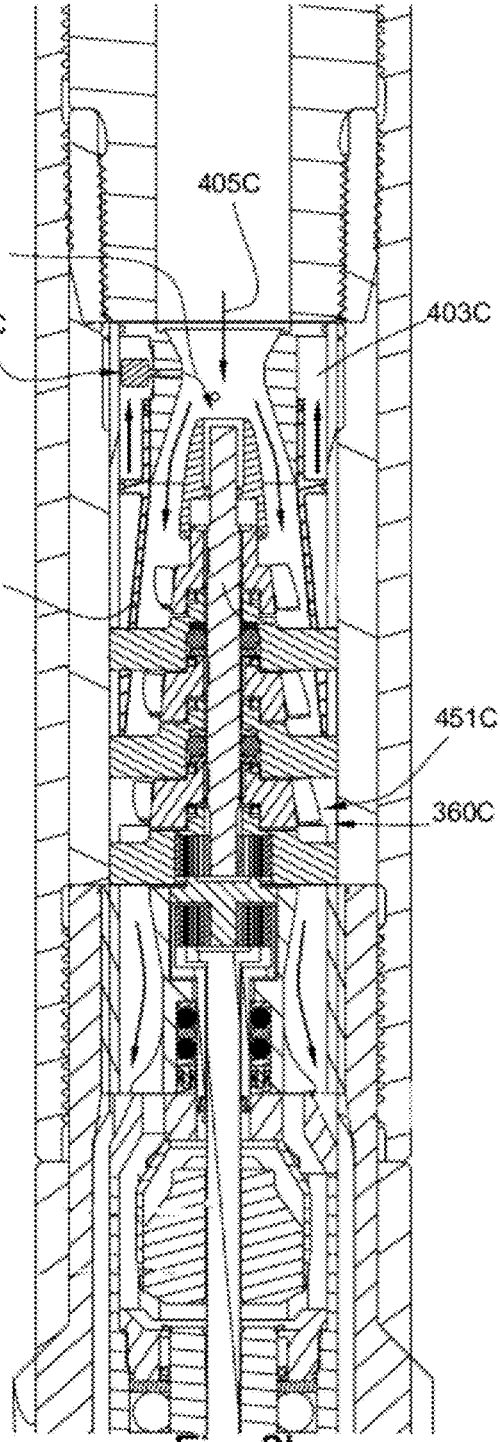
FIG. 8*b* is a cross-sectional diagram of another embodiment of a flow guide, an actuator and a turbine disposed in a drill bit.

Referring now to the embodiment disclosed in FIGS. 8*a* and 8*b*, an actuator 402C may comprise a solenoid valve 402C adapted to direct drilling fluid 405C into and out of a hydraulic piston 403C formed by the flow guide 304C and the wall of the bore 208C. The solenoid valve 402C may direct drilling fluid 405C into the hydraulic piston 403C through a high pressure port 830C and the solenoid valve 402 may direct drilling fluid 405 out of the hydraulic piston 403C through a low pressure port 831C. As the solenoid valve 402C directs drilling fluid 405C into the hydraulic piston 403C the hydraulic piston 403C moves the flow guide 304C towards the bottom end 360C of the turbine 360C. As the flow guide 304C moves towards the bottom end 360C of the turbine 360C the flow guide 304C may restrict the flow space across the turbine 207C increasing the velocity 450C of the drilling fluid 405C across the turbine 207C and increasing the rotational speed of the turbine 207C. As the solenoid valve 402C directs drilling fluid out of the hydraulic piston 403C the hydraulic piston 403C moves the flow guide 304C away from the bottom end 360C of the turbine 207C. As the flow guide 304C moves away from the bottom end 360C of the turbine 207C the flow space across the turbine 207C may increase 451C decreasing the velocity of the drilling fluid 405C across the turbine 207C and decreasing the rotational speed of the turbine 207.

Figure 9:
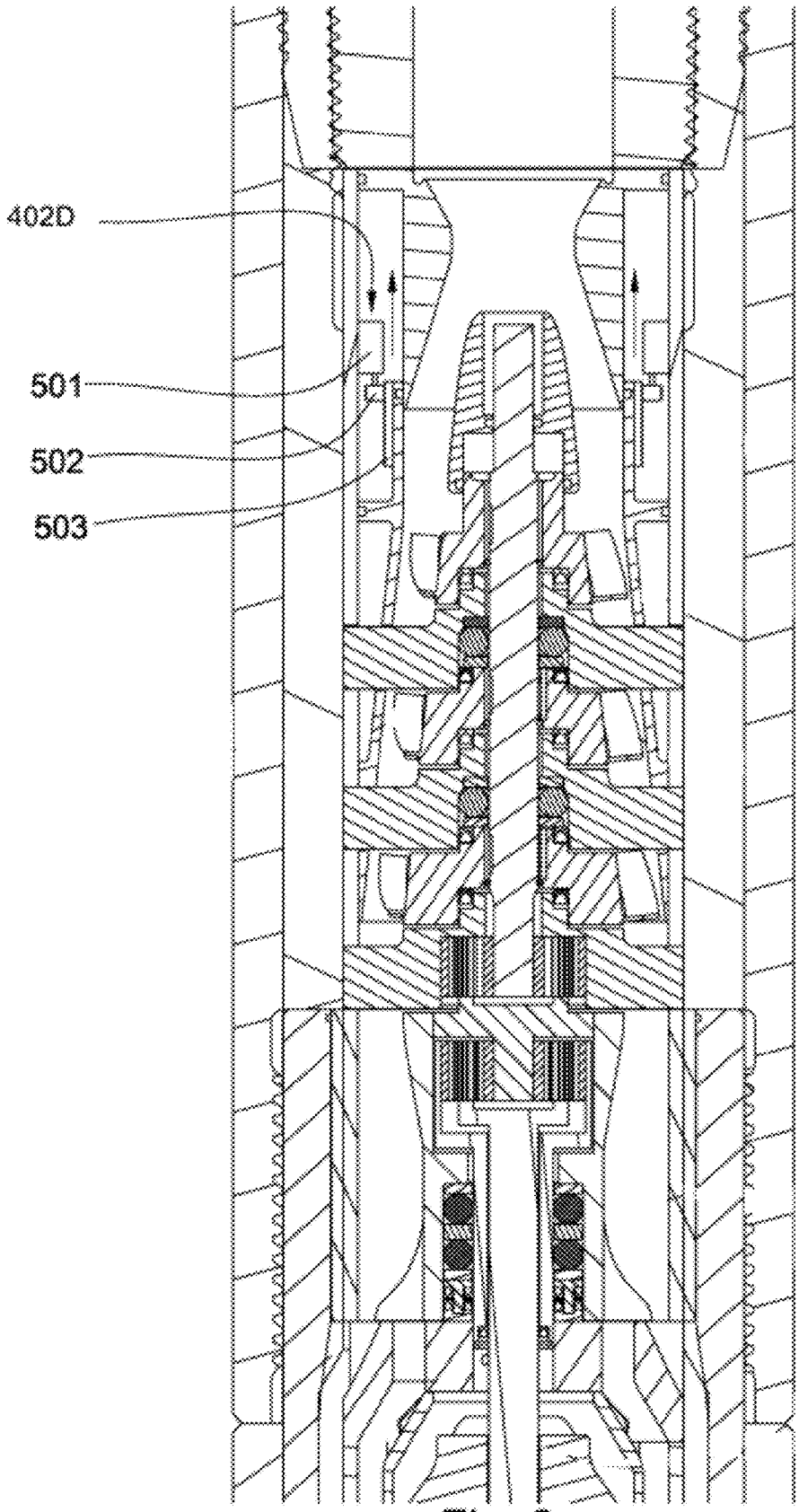
FIG. 9 is a cross-sectional diagram of another embodiment of a flow guide, an actuator and a turbine disposed in a drill bit.

FIG. 9 discloses an embodiment wherein the actuator 402D may comprise at least one dc motor 501 in communication with a rack 503 and pinion 502. The rack 503 may be connected to the flow guide 304 and the pinion 502 may comprise a worm gear 502.

Figure 10:
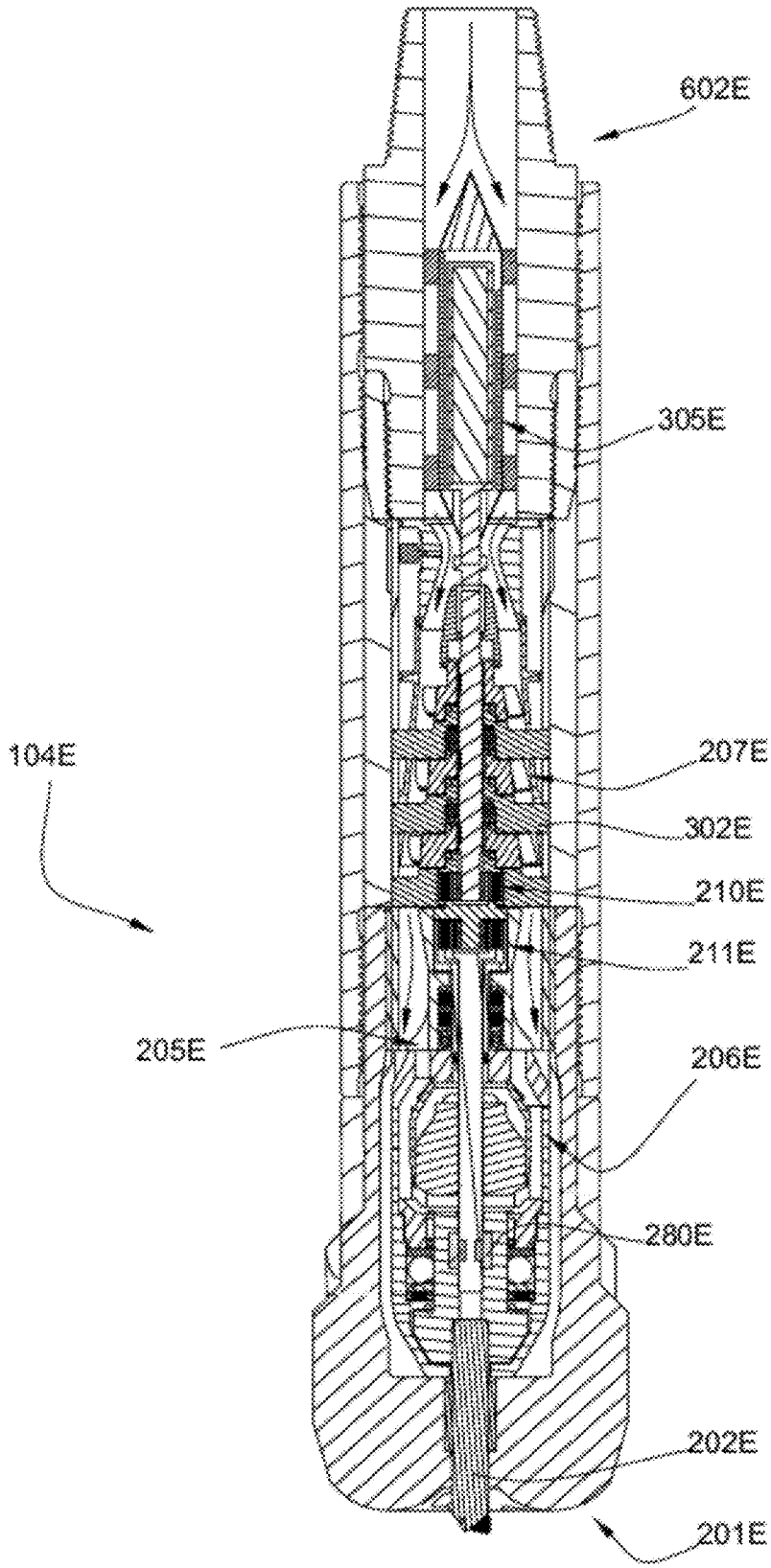
FIG. 10 is a cross-sectional diagram of an embodiment of a drill bit in communication with a component of a drill string.

Referring now to the embodiment of FIG. 10, a turbine 207E may be adapted to actuate 213*a* flow valve 205E. A second gear box 210E may be disposed between the turbine 207E and a porting mechanism 206E. The second gear box 210E may be adapted to transfer torque from a drive shaft 303E of the turbine 207E to the flow valve 205E. The second gear box 210E may transfer torque at a different magnitude to the flow valve 205E from the turbine 207E than a magnitude of torque transferred to the jack element 202E from the turbine 207E by a first gear box 211E. Sensors 280E may also be disposed proximate magnets connected to a drive rod of the second gear box 210E that transfers torque to the flow valve 205E. The sensors 280E may be adapted to detect the orientation of the flow valve 205E and the rotational speed of the flow valve 205E. Stators 302E may be disposed in the bore 208E proximate the turbine 207E and may assist in positioning the turbine 207E in the bore 208E. The electrical generator 305E may be disposed in a component 602E of the drill string 100E in communication with the drill bit 104E. The electrical generator 305E may be disposed in the drill bit 104E and the turbine 207E may be disposed in the component 602E of the drill string 100E in communication with the drill bit 104E. The electrical generator 305E may provide electrical power to the actuator 402E, to the sensors 280E, to the telemetry system, and instruments in communication with the drill string 100E.

Figure 11:
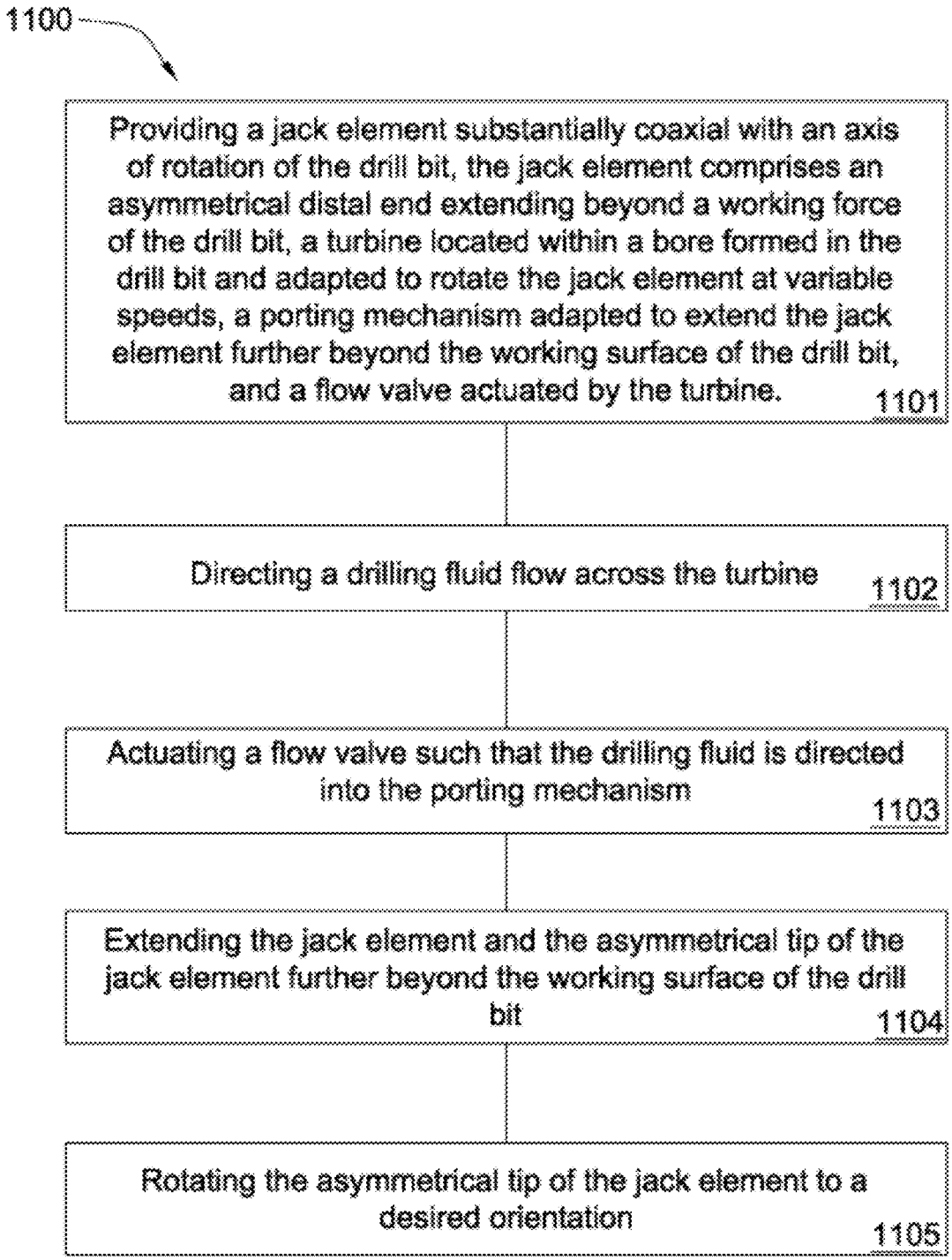
FIG. 11 is a flow diagram of an embodiment of a method for steering a drill bit through a formation.

FIG. 11 is a method 1100 of an embodiment for steering a drill bit through a formation and may use the steps of providing 1101 a jack element substantially coaxial with an axis of rotation of the drill bit, the jack element comprises an asymmetrical distal end extending beyond a working face of the drill bit, a turbine located within a bore formed in the drill bit and adapted to rotate the jack element at variable speeds, a porting mechanism adapted to extend the jack element farther beyond the working surface of the drill bit, and a flow valve actuated by the turbine; directing 1102 a drilling fluid flow across the turbine; actuating 1103 a flow valve such that the drilling fluid is directed into the porting mechanism; extending 1104 the jack element and the asymmetrical tip of the jack element farther beyond the working surface of the drill bit; and rotating 1105 the asymmetrical tip of the jack element to a desired orientation.

Figure 12:
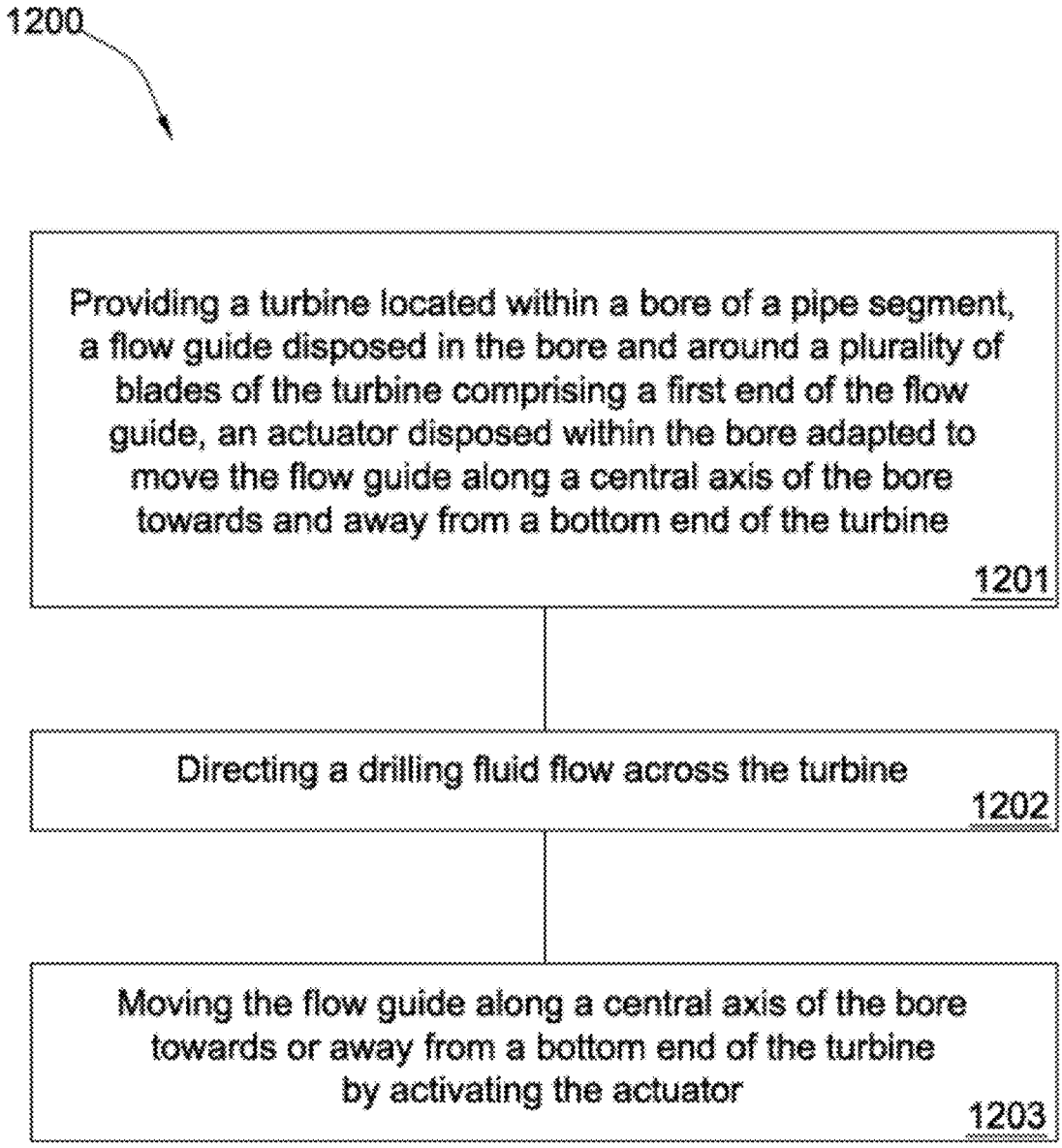
FIG. 12 is a flow diagram of an embodiment of a method for adjusting the rotational speed of a turbine.

FIG. 12 is a method 1200 of an embodiment for adjusting the rotational speed of a turbine and may use the steps of providing 1201 a turbine located within a bore of a pipe segment, a flow guide disposed in the bore and around a plurality of blades of the turbine comprising a first end with a diameter larger than a diameter of a second end of the flow guide, an actuator disposed within the bore adapted to move the flow guide along a central axis of the bore towards and away from a bottom end of the turbine; directing 1202 a drilling fluid flow across the turbine; and moving 1203 the flow guide along a central axis of the bore towards or away from a bottom end of the turbine by activating the actuator.

Whereas the present invention has been described in particular relation to the drawings attached hereto, it should be understood that other and farther modifications apart from those shown or suggested herein, may be made within the scope and spirit of the present invention.

What is claimed is:

1. A pipe segment, comprising;

a cylindrical body having an inner surface defining a longitudinal bore;

an inlet in fluid communication with said longitudinal bore, said inlet adapted to receive a flow of a fluid;

a turbine having a plurality of blades and said turbine being disposed within said longitudinal bore;

a flow guide disposed within said longitudinal bore about said plurality of blades, said flow guide adapted to guide said flow of a fluid in said pipe segment across said turbine;

an actuating mechanism disposed within said longitudinal bore and configured to cause said flow guide to change from a first position to a second position;

a jack element disposed proximate a working surface of the pipe segment;

a porting mechanism adapted to extend said jack element beyond the working surface of the pipe segment; and a flow valve in mechanical communication with said turbine, said flow valve being actuated by said turbine and adapted to route said flow of a fluid into said porting mechanism to extend said jack element.

2. The pipe segment of claim 1, wherein said pipe segment is incorporated into a drill string.

3. The pipe segment of claim 2, wherein fluid pressure fluctuations within said bore due to a change of a rotational speed of said turbine is detectable elsewhere along said drill string.

4. The pipe segment of claim 1, wherein the pipe segment is incorporated into an oil pipeline, a gas pipeline, a sewage pipeline, a water pipeline, or combinations thereof.

5. The pipe segment of claim 1, wherein said pipe segment is a drill bit.

6. The pipe segment of claim 1, wherein said flow valve is adapted to route said flow of a fluid from said porting mechanism out of the porting mechanism.

7. The pipe segment of claim 1, wherein said porting mechanism includes a piston adapted to extend said jack element beyond a working surface of said drill bit.

8. The pipe segment of claim 1, wherein said jack element has an asymmetrical distal end.

9. The pipe segment of claim 1, wherein said turbine is adapted to rotate said jack element at variable speeds.

10. The pipe segment of claim 1, wherein said turbine rotates said jack element in a direction opposite to a direction of rotation of said drill bit.

11. The pipe segment of claim 1, further comprising magnets connected to said jack element and sensors disposed proximate said magnets, wherein said sensors are adapted to detect an orientation of said jack element and a rotational speed of said jack element.

12. The pipe segment of claim 1, wherein said actuating mechanism includes a solenoid valve, an aspirator, a hydraulic piston, a pump, a dc motor, an ac motor, or a rack and pinion.

13. The pipe segment of claim 1, wherein said turbine actuates an electrical generator disposed in said pipe segment.

14. The pipe segment of claim 1 further comprising a gear box disposed between said turbine and said flow valve, wherein said gear box is adapted to transfer torque from said turbine to said flow valve.

15. The pipe segment of claim 1, wherein said mechanism is adapted to change an engagement angle of said turbine blades and/or stator associated with the turbine.

16. The pipe segment of claim 1, wherein said pipe segment is in data communication with a telemetry network.

17. A method for adjusting the rotational speed of a turbine, the method comprising the steps of:

accessing a pipe segment having a turbine with a plurality of blades, said turbine located within a bore of said pipe segment, a flow guide disposed in said bore about said plurality of blades said flow guide having a first end with a diameter larger than a diameter of a second end, and an actuator disposed within said bore adapted to move said flow guide along a central axis of the bore towards and away from a bottom end of the turbine;

directing a drilling fluid flow across said turbine; and causing said actuator to move said flow guide along a central axis of the bore towards or away from a bottom end of said turbine.

* * * * *